US011312148B2

(12) United States Patent
Smith et al.

(10) Patent No.: US 11,312,148 B2
(45) Date of Patent: Apr. 26, 2022

(54) PRINT SUBSTANCE GAUGE AUTHENTICATION

(71) Applicant: Hewlett-Packard Development Company, L.P., Spring, TX (US)

(72) Inventors: Kenneth K. Smith, Boise, ID (US); Andrew P. Chick, Vancouver, WA (US); Pratik Shah, San Diego, CA (US); Adam Hornstein, San Diego, CA (US); Dustin C. Rosing, San Diego, CA (US); Steven Motzkus, San Diego, CA (US); Matthew James Storey, Austin, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/734,764

(22) PCT Filed: Nov. 15, 2018

(86) PCT No.: PCT/US2018/061234
§ 371 (c)(1),
(2) Date: Dec. 3, 2020

(87) PCT Pub. No.: WO2020/101686
PCT Pub. Date: May 22, 2020

(65) Prior Publication Data

US 2021/0260884 A1 Aug. 26, 2021

(51) Int. Cl.
*B41J 2/175* (2006.01)
*B41J 29/58* (2006.01)

(52) U.S. Cl.
CPC ..... *B41J 2/17566* (2013.01); *B41J 2/17546* (2013.01); *B41J 2/17553* (2013.01); *B41J 29/58* (2013.01)

(58) Field of Classification Search
CPC .. B41J 2/17506; B41J 2/17509; B41J 2/1752; B41J 2/17546; B41J 2/17553; B41J 2/17566; B41J 2/195; B41J 29/58; G03G 15/502; G03G 15/556; G03G 21/00; G03G 21/105; G03G 2221/1654
See application file for complete search history.

(56) References Cited

U.S. PATENT DOCUMENTS

| | | | |
|---|---|---|---|
| 6,945,640 | B2 | 9/2005 | Cheok |
| 7,344,232 | B2 | 3/2008 | Silverbrook |
| 7,588,301 | B2 | 9/2009 | Silverbrook et al. |
| 7,611,234 | B2 | 11/2009 | Silverbrook et al. |

(Continued)

FOREIGN PATENT DOCUMENTS

| | | | |
|---|---|---|---|
| JP | H07-333959 | A | 12/1995 |
| WO | WO-2018/174893 | A1 | 9/2018 |

*Primary Examiner* — Anh T Vo
(74) *Attorney, Agent, or Firm* — Jefferson IP Law, LLP

(57) ABSTRACT

In some examples, an apparatus can include a print substance gauge to indicate a quantity of print particles an imaging device is capable of receiving at a particular time, and an authentication mechanism coupled to a locking mechanism, the authentication mechanism includes instructions to: determine a quantity of print particles within a print particle container, and unlock the locking mechanism when the print substance gauge indicates that the imagining device is capable of receiving the quantity of print particles within the print particle container.

15 Claims, 5 Drawing Sheets

(56) References Cited

U.S. PATENT DOCUMENTS

| | | | | |
|---|---|---|---|---|
| 8,002,393 | B2 | 8/2011 | Silverbrook et al. | |
| 8,009,015 | B2 | 8/2011 | Sayers et al. | |
| 8,559,830 | B2 | 10/2013 | Wayman et al. | |
| 9,454,098 | B2 | 9/2016 | Luke | |
| 10,061,245 | B2 * | 8/2018 | Takahashi | G03G 21/1676 |
| 11,221,809 | B2 * | 1/2022 | Smith | G06F 3/1219 |
| 2010/0272452 | A1 | 10/2010 | Tsukijima | |
| 2010/0329704 | A1 | 12/2010 | Tachibana | |
| 2011/0058825 | A1 | 3/2011 | Tsukijima | |
| 2016/0187839 | A1 | 6/2016 | Ueyama et al. | |
| 2017/0102637 | A1 | 4/2017 | Seto | |
| 2018/0210370 | A1 | 7/2018 | Wakimoto et al. | |

* cited by examiner

PRINT SUBSTANCE GAUGE AUTHENTICATION

BACKGROUND

Imaging systems, such as printers, copiers, etc., may be used to form markings on a physical medium, such as text, images, etc. In some examples, imaging systems may form markings on the physical medium by performing a print job. A print job can include forming markings such as text and/or images by transferring a print substance (e.g., ink, toner, etc.) to the physical medium.

DETAILED DESCRIPTION

Figure 1:
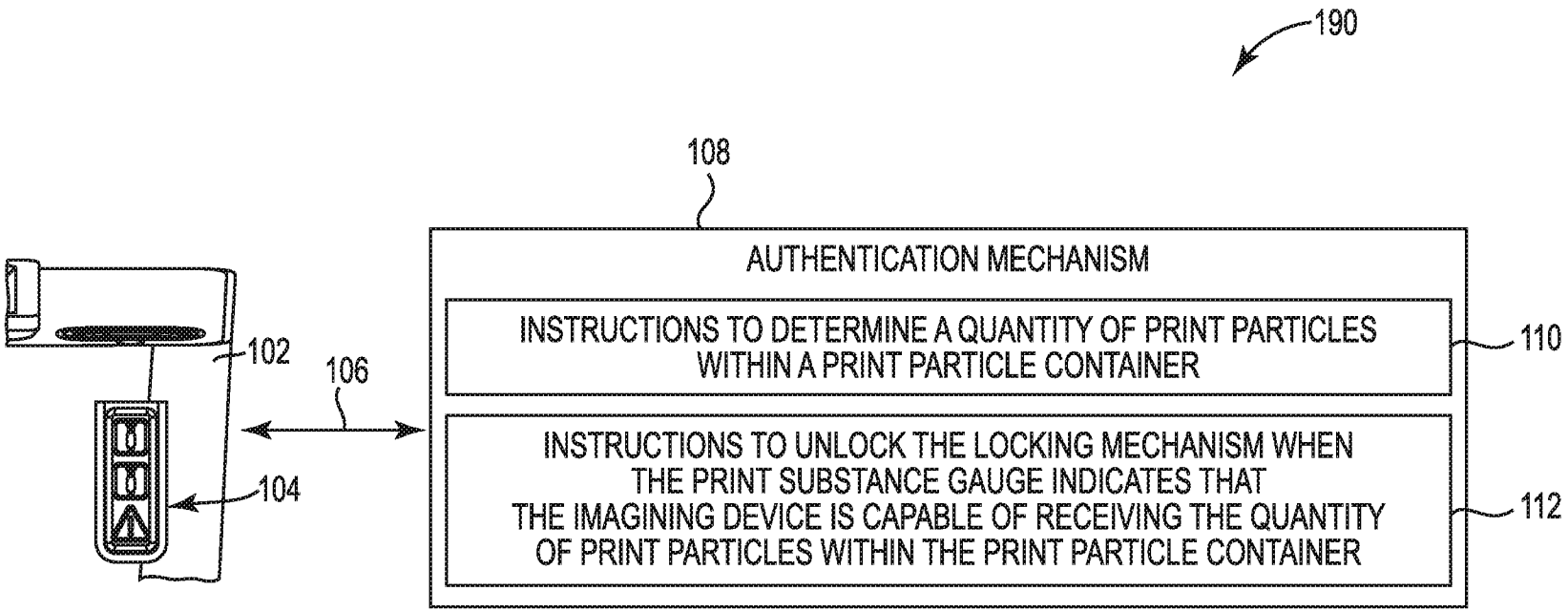
FIG. 1 illustrates a view of an example of an apparatus for print substance gauge authentication consistent with the disclosure.

Imaging devices may include a supply of a print particles located in a reservoir. As used herein, the term "print particles" refers to a substance which, when applied to a medium, can form representation(s) on the medium. For example, the print particles can include toner particles that can be utilized for an imaging device such as a laser printing device. In this example, the print particles can be deposited on to a physical print medium such as paper to generate images on the paper.

In some examples, the print particles can be deposited in successive layers to create three-dimensional (3D) objects. For example, print particles can include a powdered semi-crystalline thermoplastic material, a powdered metal material, a powdered plastic material, a powdered composite material, a powdered ceramic material, a powdered glass material, a powdered resin material, and/or a powdered polymer material, among other types of powdered or particulate material. The print particles can be particles with an average diameter of less than one hundred microns. For example, the print particles can be particles with an average diameter of between 0-100 microns. However, examples of the disclosure are not so limited. For example, print particles can be particles with an average diameter of between 20-50 microns, 5-10 microns, or any other range between 0-100 microns. The print particles can be fused when deposited to create 3D objects.

The reservoir including the print particles may be inside of the imaging device and include a supply of the print particles such that the imaging device may draw the print particles from the reservoir as the imaging device creates the images on the print medium. As used herein, the term "reservoir" refers to a container, a tank, and/or a similar vessel to store a supply of the print particles for use by the imaging device.

As the imaging device draws the print particles from the reservoir, the amount of print particles in the reservoir may deplete. As a result, the amount of print particles in the reservoir of the imaging device may have to be replenished. In some examples, the reservoir can have a capacity for storing the print particles. For example, the reservoir can be filled or refilled to a threshold quantity of print particles. In some examples, the imaging device can be damaged when the reservoir is filled or refilled beyond the threshold quantity of print particles.

A print particles container may be utilized to fill and/or refill the reservoir of the imaging device with print particles. During a fill and/or refill operation, the print particles container can transfer print particles from the print particles container to the reservoir of the imaging device. As described herein, overfilling the reservoir of the imaging device or filling the reservoir of the imaging device over a threshold level can cause damage to the imaging device.

The present disclosure describes authenticating a print particle container through a mating interface of the imaging device. For example, an authentication mechanism can determine a quantity of print particles the reservoir is capable of receiving without exceeding a threshold and determine if the print particles within a particular print particle container can be deposited into the reservoir without exceeding the threshold. In some examples, it can difficult to deposit only a portion of the print particles within the print particle container. In some examples, the print particle container can include a print particle dispense nozzle. As used herein, a print particle dispense nozzle can be a device to fill/refill the reservoir of the imaging device. In some examples, an apparatus can authenticate a quantity of print particles within the print particle dispense nozzle prior to allowing the print particle dispense nozzle to provide the print particles into the reservoir of the imaging device.

In some examples, it can be assumed that the entire contents or a relatively large portion of the print particles within the print particles container will be deposited into the reservoir if the print particles container is authenticated. Thus, the authentication mechanism can authenticate the print particles container when the reservoir is capable of receiving the quantity of print particles within the print particles container and not authenticate the print particles container when the quantity of print particles within the print particles container would exceed a threshold for the reservoir. In these examples, the authentication mechanism can be utilized to unlock a locking mechanism to allow the print particles to be deposited into the reservoir when the print particles container is authenticated, and the locking mechanism can prevent the print particles from being deposited into the reservoir when the threshold of the reservoir would be exceeded.

FIG. 1 illustrates a view of an example of an apparatus 100 for print substance gauge authentication consistent with the disclosure. In some examples, the apparatus 100 can include an imaging device 102 with a print substance gauge 104. In some examples, the imaging device 102 can be a printing device that can deposit print particles on a print medium.

In some examples, the print substance gauge 104 can be utilized to display a quantity of print particles within a reservoir of the imaging device 102. In some examples, the print substance gauge 104 can be positioned at an exterior position of the imaging device 102. For example, the print substance gauge 104 can be coupled to an exterior portion of a housing of the imaging device 102. In some examples, the print substance gauge 104 can be utilized to display a quantity of print particles that the reservoir of the imaging device 102 can receive a particular time. For example, the print substance gauge 104 can display a quantity of print particles and/or a quantity of print particle containers of a particle size that can be deposited within the reservoir of the imaging device 102 without overfilling or exceeding a threshold quantity of print particles within the reservoir. That is, the print substance gauge 104 can display the quantity of print particles the imaging device is capable of receiving at the particular time a print substance is inserted into the mating interface of the imaging device 102. In some examples, the displayed quantity is a quantity of print particle containers of a particular size the imaging device 102 can receive at the particular time. In some examples, the quantity of print particles the imaging device 102 is capable of receiving at the particular time is based on a quantity of print media generated by the imaging device 102. That is, the imaging device 102 can determine a quantity of print media that has been generated and determine a quantity of print particles within a print particle reservoir of the imaging device 102 based on the quantity of generated print media and an average quantity of print particles utilized for each sheet of print media generated.

In some examples, the print substance gauge 104 can include a user interface or display that can indicate a quantity of printer particles that can be deposited into the reservoir of the imaging device 102. In some examples, the print substance gauge 104 can also indicate when a quantity of print particles within the reservoir of the imaging device 102 has exceeded a threshold quantity of print particles and/or is within a range that is approaching the threshold quantity of print particles. In this way, a notification can be provided by the print substance gauge 104 that the imaging device 102 has exceeded a threshold quantity of print particles and/or additional print particles should not be added to the reservoir of the imaging device 102.

In some examples, the print substance gauge 104 can be positioned proximate to a mating interface that can receive a print particles container and/or print particle nozzle of the print particles container. In some examples, the mating interface can be utilized to retrieve information from the print particles container. For example, the mating interface can be utilized to receive information from the print particle container when the print particle nozzle includes a device to transmit information to the mating interface. In some examples, the information from the print particle container can include, but is not limited to, a type of print particles, a quantity of print particles, a manufacturer of the print particles, among other information relating to the print particle container and/or the print particles within the print particle container.

In some examples, the apparatus 100 can include an authentication mechanism 108 communicatively coupled to the imaging device 102 through a communication channel 106. As used herein, communicatively coupled can include a wired or wireless connection that allows communication between a number of devices. For example, the communication channel 106 can allow the authentication mechanism 108 to send and receive messages with the imaging device 102. In some examples, the communication channel 106 can be utilized to transmit the information from the print particle container to the authentication mechanism 108. In some examples, the authentication mechanism 108 can be utilized to authenticate that a quantity of print particles within a print particle container will not exceed a threshold of the reservoir of the imaging device 102.

In some examples, the authentication mechanism 108 can be a computing device. For example, the authentication mechanism 108 can include a processing resource and a memory resource to store instructions that are executable by the processing resource to perform a number of functions. In some examples, a memory resource can be utilized to store instructions 110, 112 that can be executed by a processing resource to perform functions described herein. In some examples, the processing resource can be coupled to the memory resource via a communication channel. A processing resource may be a central processing unit (CPU), microprocessor, and/or other hardware device suitable for retrieval and execution of instructions stored in memory resource.

A memory resource may be any electronic, magnetic, optical, or other physical storage device that stores executable instructions 110, 112. Thus, memory resource may be, for example, Random Access Memory (RAM), an Electrically-Erasable Programmable Read-Only Memory (EEPROM), a storage drive, an optical disc, and the like. The executable instructions 110, 112 may be stored on the memory resource. The memory resource may be a portable, external or remote storage medium, for example, that allows the instructions 110, 112 to be downloaded from the portable/external/remote storage medium. In this situation, the executable instructions 110, 112 may be part of an "installation package". As described herein, memory resource may be encoded with executable instructions 110, 112 for authenticating a print substance container as described herein.

In some examples, the authentication mechanism 108 can include instructions 110 that when executed by a processing resource can determine a quantity of print particles within a print particles container. As described herein, the authentication mechanism 108 can receive information relating to the print particles container through communication channel 106. In some examples, the information relating to the print particles container can include a quantity of print particles contained within the print particles container. In some examples, the information can be read or retrieved from the print particle nozzle of the print particles container. In some examples, the quantity of print particles within the print particles container can be a quantity of print particles determined by the manufacturer when manufacturing the print particles container. As described herein, it can be difficult to deposit a portion of the print particles within the print particles container. Thus, it can be assumed that the quantity of print particles within the print particles container is the quantity added by the manufacturer of the print particles container.

In some examples, the authentication mechanism 108 can include instructions 112 that when executed by a processing resource can unlock the locking mechanism when the print substance gauge indicates that the imagining device is capable of receiving the quantity of print particles within the print particle container. In some examples, the locking mechanism can prevent the mating interface from moving from a closed position to an open position. As used herein, the closed position can prevent the print particles from being deposited into the reservoir of the imaging device 102 and the open position can allow the print particles to be deposited into the reservoir of the imaging device 102.

In some examples, the authentication mechanism 108 can compare the quantity of print particles within the print particles container to a quantity of print particles that can be received by the reservoir of the imaging device 102 without exceeding a threshold. In some examples, the authentication mechanism 108 can unlock the locking mechanism and/or unlock the mating interface to allow print particles to be deposited into the reservoir of the imaging device 102 when the quantity of print particles within the print particles container is less than or equal to a quantity of print particles that can be received by the reservoir of the imaging device 102. In this way, the authentication mechanism 108 can prevent the reservoir from being filled over a threshold level.

In some examples, the authentication mechanism 108 can include instructions to lock the locking mechanism when the print substance gauge indicates that the imaging device 102 is not capable of receiving the quantity of print particles within the print particle container. In this way, the print particles from the print particle container are prevented from being added to the print particle reservoir of the imaging device 102, which can prevent damage to the imaging device 102. In some examples, the print substance gauge 104 can provide a notification when the imaging device 102 is not capable of receiving the quantity of print particles within the print particle container. For example, the print substance gauge 104 can provide an alert notification to warn a user that the print particle reservoir of the imaging device 102 is not capable of receiving the quantity of print particles within the print particle container.

Figure 2:
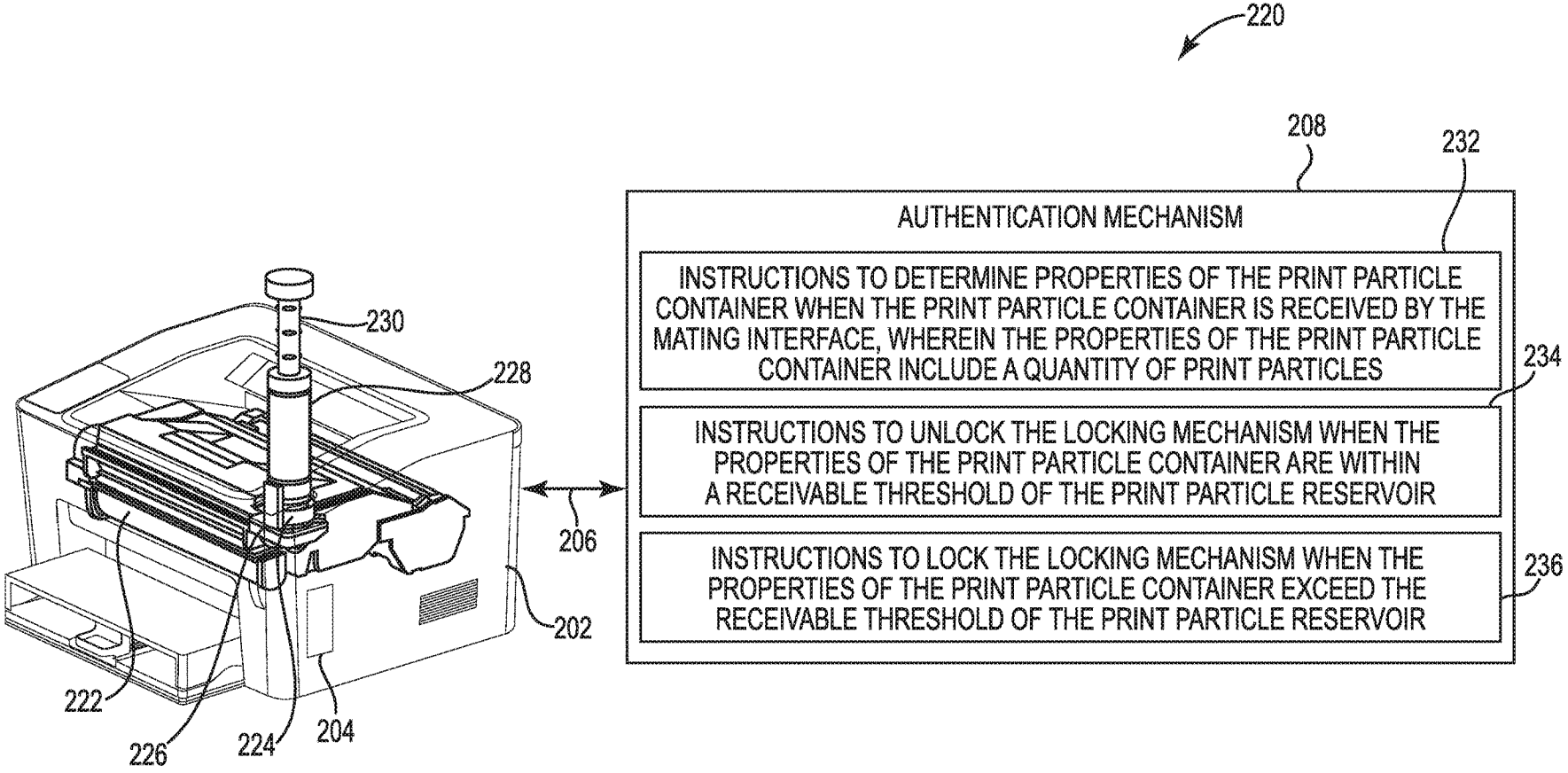
FIG. 2 illustrates a view of an example of an apparatus for print substance gauge authentication consistent with the disclosure.

FIG. 2 illustrates a view of an example of an apparatus 220 for print substance gauge authentication consistent with the disclosure. In some examples, the apparatus 220 can include an imaging device 202 with a print substance gauge 204. In some examples, the imaging device 202 can be a printing device that can deposit print particles on a print medium. In some examples, the print substance gauge 204 can be utilized to display a quantity of print particles within a reservoir 222 of the imaging device 202. In some examples, the print substance gauge 204 can be positioned at an exterior position of the imaging device 202. For example, the print substance gauge 204 can be coupled to an exterior portion of a housing of the imaging device 202.

In some examples, the apparatus 220 can include a print particle reservoir 222 of an imaging device. In some examples, the print particle reservoir 222 can be utilized to store print particles utilized by the imaging device 202. For example, the imaging device 202 can remove print particles from the print particle reservoir 222 to deposit the print particles on to a print medium. As described herein, the print particle reservoir 222 can have a threshold of print particles that can be deposited into the print particle reservoir 222. For example, print particles deposited into the print particle reservoir 222 beyond a threshold quantity of print particles can cause damage to the imaging device 202.

In some examples, the apparatus 220 can include a mating interface 224 coupled to the print particle reservoir 222 to receive a print particle container 228. In some examples, the print particle container 228 can include a print particle nozzle that can be inserted into the mating interface 224. In some examples, the mating interface 224 can be utilized to extract information from the print particle container 228 and/or the print particle nozzle of the print particle container 228. For example, the print particle nozzle of the print particle container 228 can include a computing chip that can include information that can be extracted by the mating interface 224. In some examples, the extracted information can be sent to the authentication mechanism 208 via the communication channel 206.

In some examples, the apparatus 220 can include a locking mechanism 226 coupled to the mating interface 224 to control access to the print particle reservoir 222. For example, the locking mechanism can prevent the mating interface 224 from moving from a closed position to an open position. As described herein, the closed position can prevent the print particle container 228 from depositing print particles into the print particle reservoir 222 and the open position can allow the print particle container 228 to deposit print particles into the print particle reservoir 222. In some examples, the locking mechanism 226 can be controlled by the authentication mechanism 208. For example, the authentication mechanism 208 can alter the position of the locking mechanism 226 to lock and unlock the mating interface 224.

In some examples, the print particle container 228 can include a plunger 230 that can be utilized to deposit the print particles within the print particle container 228 into the reservoir 222 when the mating interface 224 is unlocked by the locking mechanism 226 and/or in an open position as described herein. In one example, the print particle dispense nozzle of the print particle container 228 can be authenticated by the authentication mechanism 208. In this example, the mating interface 224 can be altered from a closed position to an open position. In this example, the plunger 230 can be utilized to transfer the print particles within the print particle chamber 228 through the mating interface 224 into the print particle reservoir 222.

In some examples, the apparatus 220 can include an authentication mechanism 208 communicatively coupled to the imaging device 202 through a communication channel 206. In some examples, the authentication mechanism 208 can be a computing device. For example, the authentication mechanism 208 can include a processing resource and a memory resource to store instructions 232, 234, 236 that are executable by the processing resource to perform a number of functions. In some examples, a memory resource can be utilized to store instructions 232, 234, 236 that can be executed by a processing resource to perform functions described herein. In some examples, the processing resource can be coupled to the memory resource via a communication channel. A processing resource may be a central processing unit (CPU), microprocessor, and/or other hardware device suitable for retrieval and execution of instructions stored in memory resource.

In some examples, the authentication mechanism 208 can include instructions 232 that when executed by a processing resource can determine properties of the print particle container 228 when the print particle container 228 is received by the mating interface 224, wherein the properties of the print particle container 228 include a quantity of print particles. In some examples, the authentication mechanism 208 can receive information that relates to the print particle container 228 from the mating interface 224 through the communication channel 206. As described herein, the mating interface 224 can extract information from the print particle container 228 and transmit the information through the communication channel 206 to the authentication mechanism 208.

In some examples, the information can include the properties of the print particles within the print particle container 228. For example, the information can include a type of print particles, a color of the print particles, a size of the print particles, a quantity of print particles, and/or other information that can be utilized to categorize the print particles within the print particle container 228.

In some examples, the authentication mechanism 208 can include instructions 234 that when executed by a processing resource can unlock the locking mechanism 226 when the properties of the print particle container 228 are within a receivable threshold of the print particle reservoir 222. As described herein, the authentication mechanism 208 can send a signal to the locking mechanism 226 through communication channel 206 to unlock the mating interface 224 such that the mating interface 224 can move from a closed position to an open position. In some examples, the authentication mechanism 208 can send the signal when the quantity of print particles within the print particle container 228 will not exceed a threshold of the reservoir 222 when added to the reservoir 222. That is, the print particle container 228 can be authenticated when the quantity of print particles from the print particle container 228 and an existing quantity of print particles from the reservoir 222 are added together are below a threshold quantity of print particles for the reservoir 222. In some examples, the receivable threshold can include a quantity of print particles that are receivable by the print particle container 228 without overfilling the print particle reservoir 222.

In some examples, the authentication mechanism 208 can include instructions 236 that when executed by a processing resource can lock the locking mechanism when the properties of the print particle container exceed the receivable threshold of the print particle reservoir. In some examples, locking the locking mechanism can include preventing the mating interface 224 from moving from a closed position to an open position. In this way, the print particle container 228 may not be authenticated by the authentication mechanism 208 since the quantity of print particles within the print particle container 228 would exceed a threshold of the reservoir 222. That is, when the quantity of print particles of the print particle container 228 are added to an existing quantity of print particles within the reservoir 222, the reservoir 222 would exceed the threshold quantity of print particles.

Figure 3:
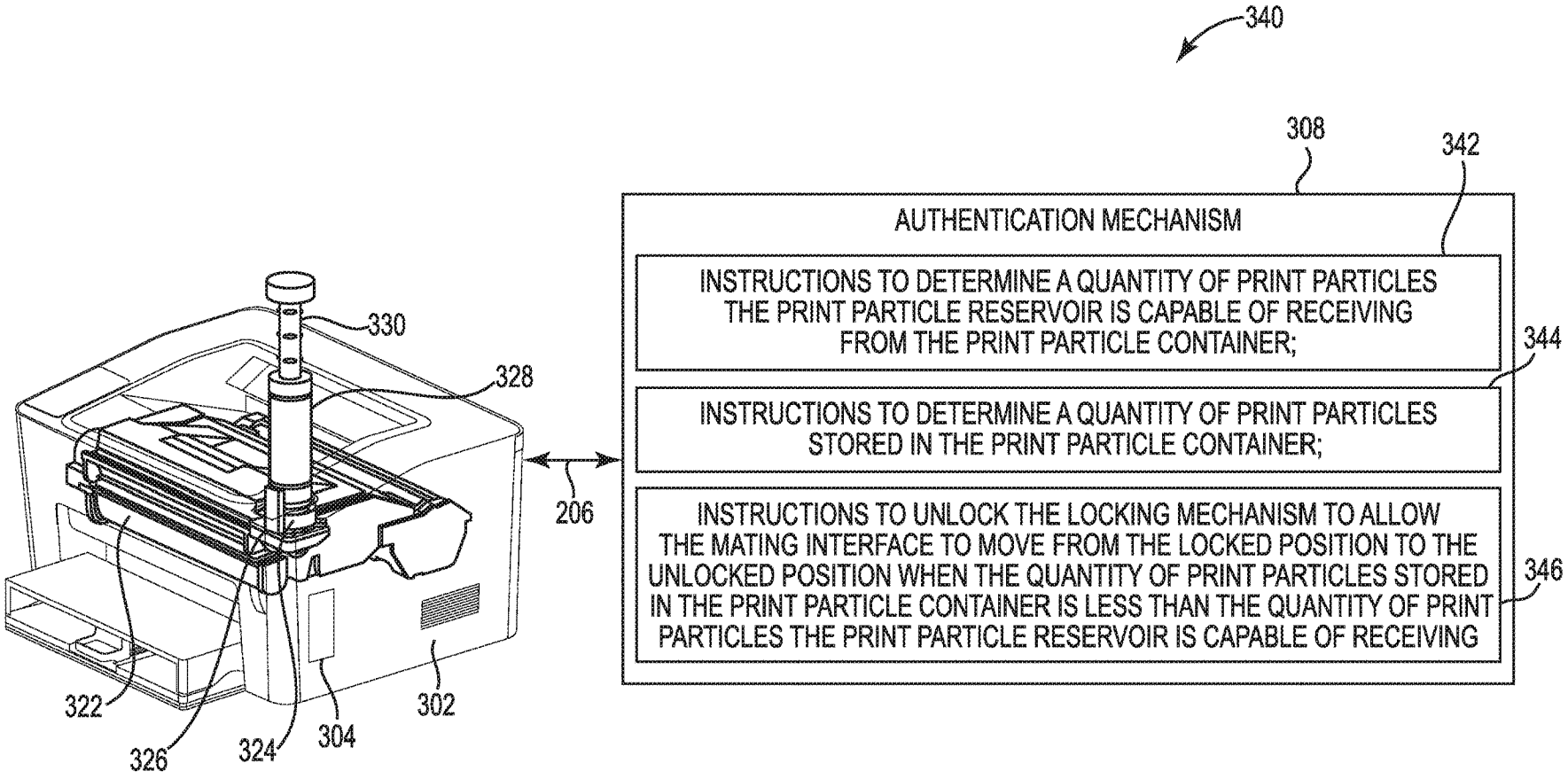
FIG. 3 illustrates a view of an example of an apparatus for print substance gauge authentication consistent with the disclosure.

FIG. 3 illustrates a view of an example of an apparatus 340 for print substance gauge authentication consistent with the disclosure. In some examples, the apparatus 340 can include an imaging device 302 with a print substance gauge 304. As described herein, the print substance gauge 304 can be utilized to display a quantity of print particles within a reservoir 322 of the imaging device 302 and/or display a quantity of print particles that can be deposited into the reservoir 322 without exceeding a threshold.

In some examples, the apparatus 340 can include a mating interface 324 coupled to the print particle reservoir 322 to receive a print particle container 328. In some examples, the print particle container 328 can include a print particle nozzle that can be inserted into the mating interface 324. In some examples, the mating interface 324 can be utilized to extract information from the print particle container 328 and/or the print particle nozzle of the print particle container 328. In some examples, the extracted information can be sent to the authentication mechanism 308 via the communication channel 306.

As described herein, the apparatus 320 can include a locking mechanism 326 coupled to the mating interface 324 to control access to the print particle reservoir 322. In some examples, the locking mechanism 326 can be controlled by the authentication mechanism 308. For example, the authentication mechanism 308 can alter the position of the locking mechanism 326 to lock and unlock the mating interface 324.

In some examples, the print particle container 328 can include a plunger 330 that can be utilized to deposit the print particles within the print particle container 328 into the reservoir 322 when the mating interface 324 is unlocked by the locking mechanism 326 and/or in an open position as described herein. In one example, the print particle dispense nozzle of the print particle container 328 can be authenticated by the authentication mechanism 308. In this example, the mating interface 324 can be altered from a closed position to an open position. In this example, the plunger 330 can be utilized to transfer the print particles within the print particle chamber 328 through the mating interface 324 into the print particle reservoir 322.

In some examples, the apparatus 320 can include an authentication mechanism 308 communicatively coupled to the imaging device 302 through a communication channel 306. In some examples, the authentication mechanism 308 can be a computing device. For example, the authentication mechanism 308 can include a processing resource and a memory resource to store instructions 342, 344, 346 that are executable by the processing resource to perform a number of functions. In some examples, a memory resource can be utilized to store instructions 342, 344, 346 that can be executed by a processing resource to perform functions described herein. In some examples, the processing resource can be coupled to the memory resource via a communication channel. A processing resource may be a central processing unit (CPU), microprocessor, and/or other hardware device suitable for retrieval and execution of instructions stored in memory resource.

In some examples, the authentication mechanism 308 can include instructions 342 that when executed by a processing resource can determine a quantity of print particles the print particle reservoir 322 is capable of receiving from the print particle container 328. As described herein, a the print particle reservoir can include a particle quantity of print particles that are stored to be used by the imaging device 302, In some examples, the authentication mechanism 308 can utilize information provided to the print substance gauge 304 to determine the quantity of print particles stored in the reservoir 322. In some examples, the quantity of print particles can be quantified by a number of different numerical values. For example, the quantity of print particles can be quantified by a quantity of sheets or pages of print media that can be generated by the quantity of print particles. In another example, the quantity of print particles can be quantified by a quantity of actual particles or a volume of the quantity of particles.

In some examples, the authentication mechanism 308 can include instructions 344 that when executed by a processing resource can determine a quantity of print particles stored in the print particle container 328. As described herein, the print particle container 328 can include information that can be extracted by the mating interface 324 and/or other element of the imaging device 302. For example, the print particle container 328 can include a computing chip or computing device that can allow the mating interface to extract information relating to the print particle container 328. In some examples, the information extracted from the print particle container 328 can be transferred to the authentication mechanism 308 through the communication channel 306. In some examples, the information extracted from the print particle container 328 can include a quantity of print particles stored in the print particle container 328.

In some examples, the authentication mechanism 308 can include instructions 346 that when executed by a processing resource can unlock the locking mechanism 326 to allow the mating interface 324 to move from the locked position to the unlocked position when the quantity of print particles stored in the print particle container 328 is less than the quantity of print particles the print particle reservoir 322 is capable of receiving. As described herein, the authentication mechanism 308 can compare the print particles that can be received by the print particle reservoir 322 without exceeding a threshold of the print particle reservoir 322. In these examples, the authentication mechanism 308 can authenticate the print particle container 328 by confirming that the print particles within the print particle container 328 can be received by the print particle reservoir 322 without exceeding a threshold of the print particle reservoir 322.

Figure 4:
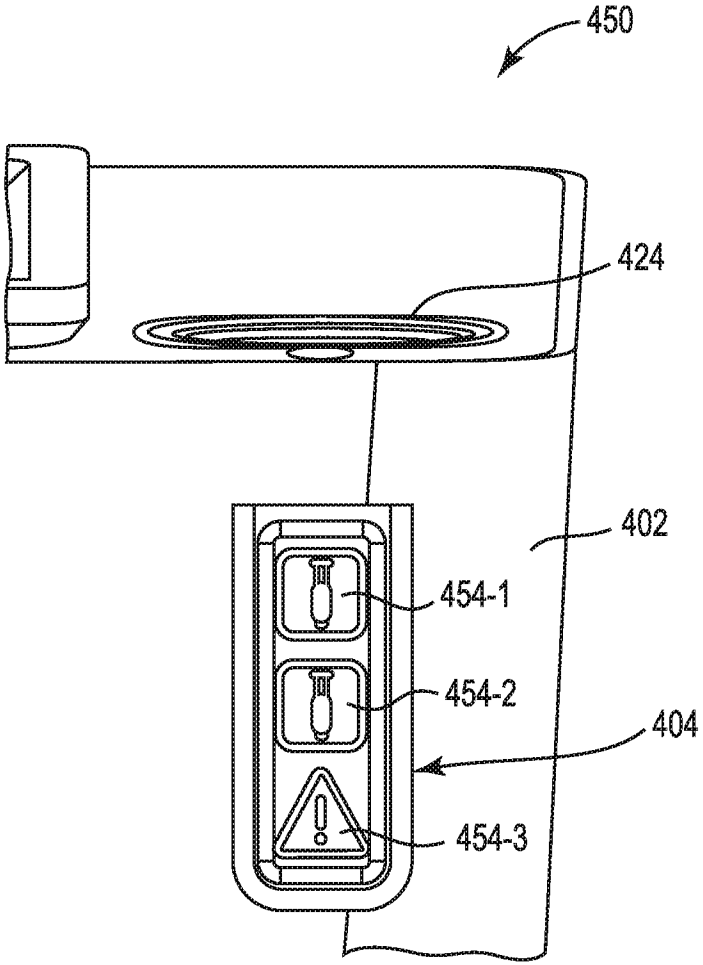
FIG. 4 illustrates a view of an example of an apparatus with a print substance gauge consistent with the disclosure.

FIG. 4 illustrates a view of an example of an apparatus 450 with a print substance gauge 404 consistent with the disclosure. The apparatus 450 can be a portion of a view of apparatus 100 as referenced in FIG. 1, apparatus 220 as referenced in FIG. 2, and/or apparatus 340 as referenced in FIG. 3. For example, the apparatus 450 can include an imaging device 402 with a mating interface 424 to receive a print particle container and/or a nozzle of a print particle container.

In some examples, the print substance gauge 404 can be utilized to display a quantity of print particles within the print particle reservoir of the imaging device 402. In some examples, the print substance gauge 404 can be utilized to display a quantity of print particle containers that can be deposited into the reservoir of the imaging device 402. For example, the imaging device 402 can include a mating interface 424 that can accept a print particle container that can include a particular quantity of print particles. In this example, the print substance gauge 404 can display a quantity of print particle containers that can be deposited into the reservoir of the imaging device through the mating interface 424 as described herein. In some examples, the print substance gauge 404 can be exposed when the print particle container is coupled to the mating interface 424. That is, the print substance gauge 404 can be utilized to notify a user even when the print particle container is inserted into the mating interface 424.

In some examples, the print substance gauge 404 can include a number of images 454-1, 454-2, 454-3 that can be utilized to notify a user of the imaging device 402, For example, the number of images 454-1, 454-2, 454-3 can include a first print substance container image 454-1, a second print substance container image 454-2, and/or an alert image 454-3, In some examples, a light source can be illuminated behind the number of images 454-1, 454-2, 454-3 when a particular image is utilized to provide a notification. For example, when an alert is activated by the imaging device 402 a light source such as a light emitting diode (LED) can be illuminated behind the alert image 454-3 to notify a user that there is an alert. In some examples, the print substance gauge 404 can provide a notification with the alert image 454-3 when the quantity of print particles stored in the print particle container is more than the quantity of print particles the print particle reservoir is capable of receiving.

In some examples, the first print substance image 454-1 can be illuminated by a light source when the reservoir of the imaging device 402 can receive a quantity of print particles within a single print particle container of a particular size (e.g., designated single size print particle container, etc.). In some examples, the second print substance image 454-2 can be illuminated by a light source when the reservoir of the imaging device 402 can receive a quantity of print particles within two print particle containers and/or a double size print particle container. In this way, the first print substance image 454-1 and the second print substance image 454-2 can be utilized to display a quantity of print particles that can be deposited within the reservoir of the imaging device 402 and/or a quantity of print particle containers that can be deposited into the reservoir of the imaging device 402.

Figure 5:
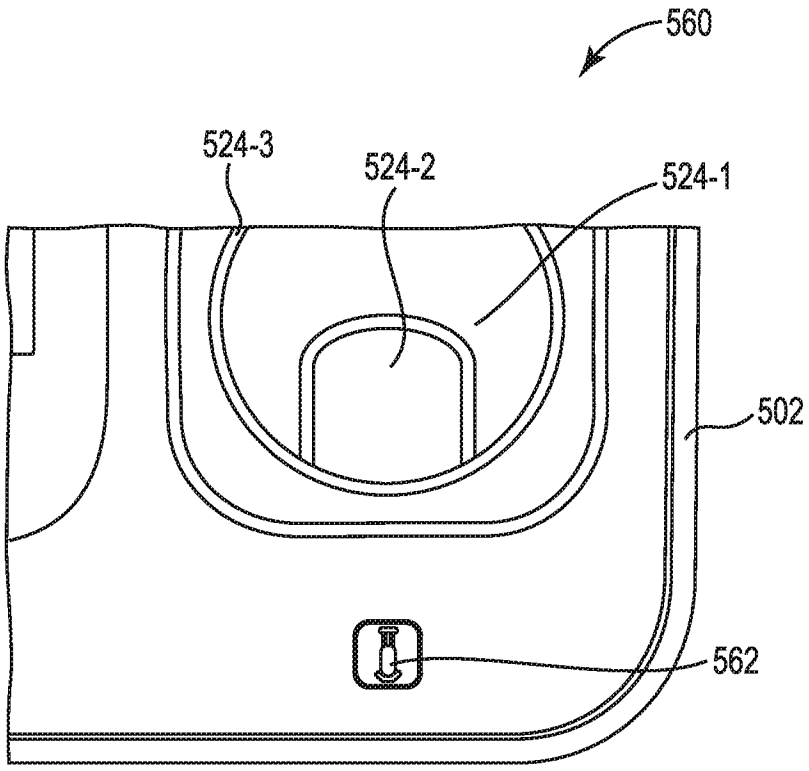
FIG. 5 illustrates a view of an example of an apparatus with a print substance gauge consistent with the disclosure.

FIG. 5 illustrates a view of an example of an apparatus 560 with a print substance gauge 562 consistent with the disclosure. The apparatus 560 can be a portion of a view of apparatus 100 as referenced in FIG. 1, apparatus 220 as referenced in FIG. 2, apparatus 340 as referenced in FIG. 3, and/or apparatus 450 as referenced in FIG. 4. For example, the apparatus 560 can include an imaging device 502 with a mating interface 524-1 to receive a print particle container and/or a nozzle of a print particle container. In some examples, the print substance gauge 562 can be exposed when the print particle container is coupled to the mating interface 524-1. That is, the print substance gauge 562 can be utilized to notify a user even when the print particle container is inserted into the mating interface 524-1.

In some examples, the apparatus 560 can include a print substance gauge 562 that can be utilized as a confirmation indicator. For example, the print substance gauge 562 can be displayed and/or illuminated by a light source when a print particle container is authenticated as described herein. As describe herein, the print particle container can be authenticated utilizing information extracted by the mating interface 524-1. In some examples, the print substance gauge 562 can provide a plurality of notifications based on whether or not the print particle container was authenticated. For example, the print substance gauge 562 can generate a number of different colors or images to indicate a plurality of different notifications.

In some examples, a first notification from the print substance gauge 562 can indicate that the print particle container is authenticated, a second notification from the print substance gauge 562 can indicate that a tab 524-2 of the mating interface 524-1 is open and the print particles of the print particle container is ready to be deposited, a third notification from the print substance gauge 562 can indicate that the print particle container was not authenticated. In some examples, additional notifications can be utilized and/or fewer notifications can be utilized.

In some examples, the mating interface 524-1 can include a mechanical feature 524-3 to prevent the print particle container from being received by the mating interface 524-1 when the print particle container includes a quantity of print particles that is greater than a threshold quantity of print particles for the print particle reservoir. In some examples, a print particle container can include a particular shape, size, or mechanical features that can prevent the print particle container from being inserted into the mating interface 524-1. In some examples, the mechanical feature 524-3 can prevent a first print particle container that has a first quantity of print particles and allow a second print particle container that has a second quantity of print particles. In this way, the quantity of print particle containers to be deposited into the reservoir of the imaging device 502 can be determined since the mating interface 524-1 may be able to accept a particular print particle container and not accept other print particle containers.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. Further, as used herein, "a" can refer to one such thing or more than one such thing.

The figures herein follow a numbering convention in which the first digit corresponds to the drawing figure number and the remaining digits identify an element or component in the drawing. For example, reference numeral 102 may refer to element 102 in FIG. 1 and an analogous element may be identified by reference numeral 202 in FIG. 2. Elements shown in the various figures herein can be added, exchanged, and/or eliminated to provide additional examples of the disclosure. In addition, the proportion and the relative scale of the elements provided in the figures are intended to illustrate the examples of the disclosure and should not be taken in a limiting sense.

It can be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" another element it is understood that are no intervening elements (adhesives, screws, other elements) etc.

The above specification, examples and data provide a description of the method and applications and use of the system and method of the disclosure. Since many examples can be made without departing from the spirit and scope of the system and method of the disclosure, this specification merely sets forth some of the many possible example configurations and implementations.

What is claimed is:

1. An apparatus, comprising:

a print substance gauge to indicate a quantity of print particles that an imaging device is capable of receiving at a particular time; and an authentication mechanism coupled to a locking mechanism, wherein the authentication mechanism includes instructions to:

determine a quantity of print particles within a print particle container; and unlock the locking mechanism based on the print substance gauge indicating that the imaging device is capable of receiving the quantity of print particles within the print particle container.

2. The apparatus of claim 1, wherein the authentication mechanism includes instructions to lock the locking mechanism based on the print substance gauge indicating that the imaging device is not capable of receiving the quantity of print particles within the print particle container.

3. The apparatus of claim 2, wherein the authentication mechanism includes instructions to provide a notification based on the imaging device not being capable of receiving the quantity of print particles within the print particle container.

4. The apparatus of claim 1, wherein the print substance gauge displays the quantity of print particles the imaging device is capable of receiving at the particular time.

5. The apparatus of claim 4, wherein the displayed quantity is a quantity of print particle containers that include an estimated page volume equivalent of print particles the imaging device can receive at the particular time.

6. The apparatus of claim 1, comprising a mating interface coupled to the locking mechanism to receive the print particle container, wherein the mating interface includes instructions to provide container information to the authentication mechanism.

7. The apparatus of claim 1, wherein the quantity of print particles the imaging device is capable of receiving at the particular time is based on a quantity of print media generated by the imaging device.

8. A print particle apparatus, comprising:

a print particle reservoir of an imaging device;

a mating interface coupled to the print particle reservoir to receive a print particle container;

a locking mechanism coupled to the mating interface to control access to the print particle reservoir; and an authentication mechanism coupled to the locking mechanism comprising instructions to:

determine properties of the print particle container based on the print particle container being received by the mating interface, wherein the properties of the print particle container include a quantity of print particles;

unlock the locking mechanism based on the properties of the print particle container being within a receivable threshold of the print particle reservoir; and lock the locking mechanism based on the properties of the print particle container exceeding the receivable threshold of the print particle reservoir.

9. The print particle apparatus of claim 8, wherein the receivable threshold is a quantity of print particles that are receivable by the print particle container without overfilling the print particle reservoir.

10. The print particle apparatus of claim 9, wherein exceeding the receivable threshold causes damage to the imaging device.

11. A system, comprising:

a housing of an imaging device;

a print particle reservoir positioned within an interior of housing of the imaging device;

a mating interface coupled to an exterior of the housing to receive a print particle container to deposit print particles into the print particle reservoir based on the mating interface being in an unlocked position;

an authentication mechanism coupled to a locking mechanism coupled to the mating interface to allow the mating interface to move from a locked position to the unlocked position, wherein the authentication mechanism includes instructions to:

determine a quantity of print particles the print particle reservoir is capable of receiving from the print particle container;

determine a quantity of print particles stored in the print particle container;

unlock the locking mechanism to allow the mating interface to move from the locked position to the unlocked position based on the quantity of print particles stored in the print particle container being less than the quantity of print particles the print particle reservoir is capable of receiving.

12. The system of claim 11, comprising a print substance gauge coupled to the exterior of the housing to indicate a quantity of print particles an imaging device is capable of receiving at a particular time.

13. The system of claim 12, wherein the print substance gauge provides a notification based on the quantity of print particles stored in the print particle container being more than the quantity of print particles the print particle reservoir is capable of receiving.

14. The system of claim 12, wherein the print substance gauge is exposed based on the print particle container being coupled to the mating interface.

15. The system of claim 11, wherein the mating interface includes a mechanical feature to prevent the print particle container from being received by the mating interface based on the print particle container including a quantity of print particles that greater than a threshold quantity of print particles for the print particle reservoir.

* * * * *